United States Patent [19]

Pincus

[11] Patent Number: 4,545,899

[45] Date of Patent: Oct. 8, 1985

[54] HYDROCYCLONES

[75] Inventor: Ivo R. Pincus, Victoria, Australia

[73] Assignee: Harrisons & Crosfield, Hawthorn, Australia

[21] Appl. No.: 577,344

[22] Filed: Feb. 6, 1984

[30] Foreign Application Priority Data

Aug. 12, 1983 [AU] Australia ..... PG0806

[51] Int. Cl.[4] ..... B04C 11/00

[52] U.S. Cl. ..... 209/211; 210/512.1; 251/61.4

[58] Field of Search ..... 209/211, 144; 210/512.1, 512.2; 55/309-311; 251/61.4

[56] References Cited

U.S. PATENT DOCUMENTS

| | | | |
|---|---|---|---|
| 571,833 | 11/1896 | Hunter | 251/61.4 |
| 2,564,569 | 8/1951 | Goehring | 251/61.4 |
| 2,680,709 | 6/1954 | Skinner | 210/512.1 |
| 2,735,547 | 2/1956 | Vissac | 210/512.1 |
| 4,303,526 | 12/1981 | Moro et al. | 209/211 |

FOREIGN PATENT DOCUMENTS

| | | | |
|---|---|---|---|
| 722488 | 11/1965 | Canada | 209/211 |
| 1293129 | 4/1969 | Fed. Rep. of Germany | 210/512.1 |
| 663300 | 12/1951 | United Kingdom | 251/61.4 |

*Primary Examiner*—Frank W. Lutter
*Assistant Examiner*—Wm. Bond
*Attorney, Agent, or Firm*—Prutzman, Kalb, Chilton & Alix

[57] ABSTRACT

A hydrocyclone comprising a frusto conical feed box extension, a feed box attached to the larger end of the feed box extension, the feed box having a tangential feed pipe, an overflow box positioned over the feed box and including an overflow pipe and a vent pipe, and a fish tail at the narrower end of the feed box extension, characterized in that a pressure compensating valve is positioned in the vent pipe, and operation of the valve is dependent on the pressure within the feed pipe. The pressure compensating valve comprises a valve member biased to an open position against a diaphragm located in a pressure chamber, one side of the diaphragm being in fluid communication with the feed pipe whereby variation of the pressure within the feed pipe causes the diaphragm to displace the valve member to a partially or totally closed position against an associated valve seat.

6 Claims, 3 Drawing Figures

HYDROCYCLONES

This invention relates to improvements in or relating to hydrocyclones.

BACKGROUND AND SUMMARY OF THE INVENTION

Hydrocyclones have for a number of years been commonly used in the beneficiation and dewatering of aqueous slurries. The popularity of hydrocyclones is due to the fact that there are no moving parts inside the cyclone. In essence a hydrocyclone comprises a frusto-conical vertical column, the larger end of which is attached to a feed box into which a tangential feed pipe communicates. An overflow box is positioned above the feed box and includes a liquids discharge pipe. The centre if the feed box includes a vortex finder and the base of the frusto-conical column terminates in a narrow opening known as a spigot or apex of the hydrocyclone. The aqueous slurry is forced at high pressure tangentially into the feed box, this causes rotation of the slurry within the feed box and frusto-conical column or feed box extension. Solids are flung to the wall of the conical column and spiral down to the spigot. The bulk of the liquid spirals upwards and leaves the cyclone through the discharge pipe via the vortex finder. The solids fraction leaving through the spigot are determined by the spigot to vortex finder relationship. The only solids to escape with the bulk of the water are the particles which are so fine that the entrainment or drag forces are not overcome by the centrifugal forces. Consequently for any given feed pressure/rotational speed there is a "cut size" at which the drag and centrifugal forces are in balance. Particles finer than this cut size are dragged with the bulk of the liquid through the vortex finder, and particles coarser than the cut size report to the spigot.

It is also known to adapt hydrocyclones of the kind described above by attaching at the spigot or apex a device called a fishtail. The purpose of the fishtail is to regulate the amount of water which is delivered from the hydrocyclone with the spigot discharge. Without the fishtail, the centrifugal action of the cyclone tends to produce a cylindrical air core in the centre of the feed box extension. The cylindrical air core causes an upward stream of water and air to the overflow box. When the solid content/pressure of the infeed vary the presence of air in the feed box extension tends to cause a substantial variation in the solid content of the discharge. The fishtail is attached to the spigot to ensure both control and consistent solid content of the discharge. The fishtail comprises a one way valve formed by soft rubber lips in a manner similar to a gas-mask. This valve allows periodic release of discharge solids but prevents entry of air, and thus effectively removes the cylindrical air core.

Since no air is drawn into the cyclone the discharge of the water from the overflow pipe causes a vacuum within the cyclone. When the infeed pressure reaches a certain level this vacuum can be so great as to cause upward movement of the solids from the non-return valve of the fishtail thereby cause the cyclone to choke. Consequently hydrocyclones incorporating fishtails are provided with a vent pipe to allow air to enter the overflow box to reduce the siphon effect and consequently the vacuum within the hydrocyclone. It is usual to provide an adjustable gate valve to vary and adjust the entry of air via the vent pipe. However, the gate valve only provides a single setting at any particular time and therefore this arrangement only works satisfactorily for a limited range of operation of the cyclone. When feed tonnages rise excessively the cyclone may well choke thereby requiring further adjustment of the gate valve to reduce the siphon and allow freer discharge from the spigot.

It is problems of this kind that have brought about the present invention.

The hydrocyclone of the kind set forth herein comprises a frusto-conical feedbox extension having attached at the large end a feedbox which includes a tangential feedpipe, an overflow box above the feedbox including an overflow pipe and a vent pipe, the narrow end of the feedbox extension having attached thereto a fishtail.

According to one aspect of the present invention there is provided a hydrocyclone of the kind set forth herein in which a pressure compensating valve is provided in the vent pipe, the operation of the valve being dependent on the pressure in the feed pipe of the hydrocyclone.

Preferably the pressure compensating valve comprises valve member biased to an open position against a diaphragm located in a pressure chamber, one side of the diaphragm being in fluid communication with the infeed pressure whereby variation of the infeed pressure partially or totally closes the valve member against an associated valve seat. Preferably the valve member is coupled to the diaphragm via a rod, and a coil spring co-axially surrounds the rod. In a preferred embodiment the spring rate of the coil spring is adjustable.

The valve member is preferably tapered to seat in a correspondingly tapered seat.

One embodiment of the present invention will now be described by way of example only with reference to the accompanying drawings in which:

DESCRIPTION OF A PREFERRED EMBODIMENT

Figure 1:
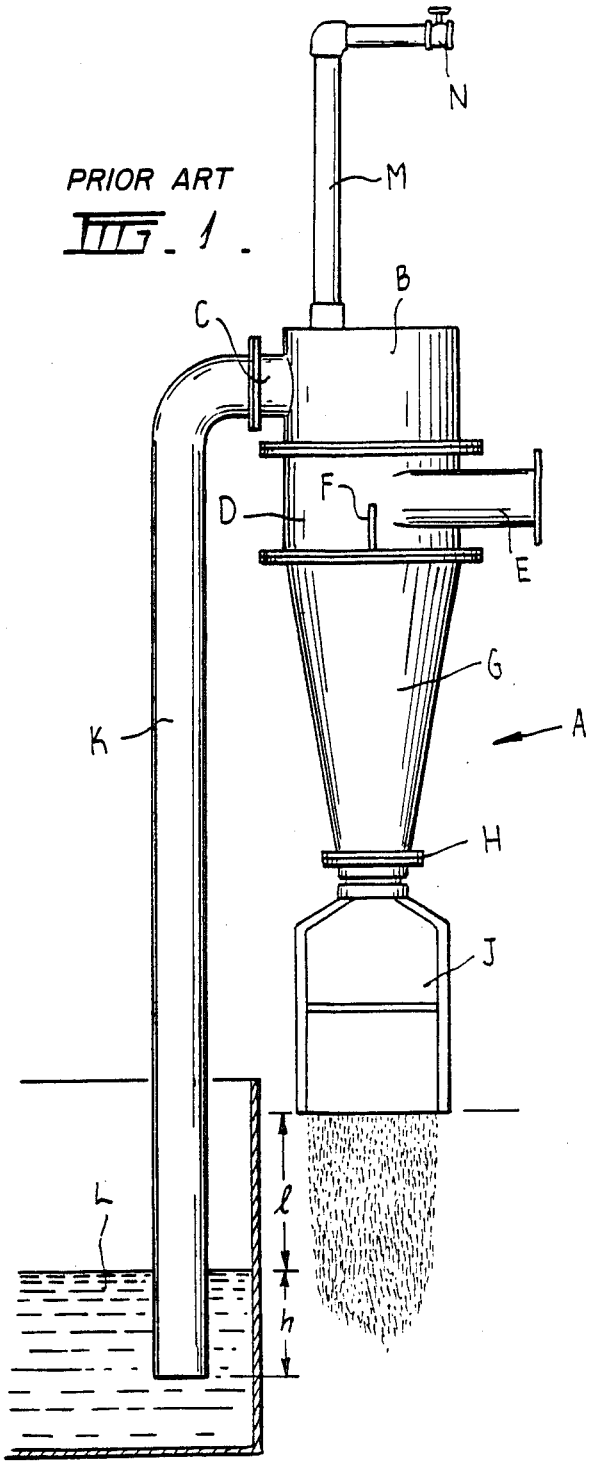
PRIOR ART FIG. 1.
FIG. 1 is a side elevational view of a conventional hydrocyclone.

A hydrocyclone A as illustrated in FIG. 1 comprises vertically extending column includes the following components coupled in series from top to bottom, a cylindrical overflow box B including an outlet pipe C, feedbox D that includes a tangentially arranged feedpipe E and a centrally positioned vortex finder F, a frusto-conical feedbox extension G, a spigot H and a fishtail J. Overflow pipe C terminates in a downwardly extending pipe K that is submerged in a tank of water L to a height h below the surface of the water. The fishtail J is in the form of a pair of soft rubber plates that are in close abuttment to effectively produce a one-way valve that allows discharge of solid matter therethrough but does not allow entry of air. The base of the fishtail J is arranged to be at a height l above the level of the water in the tank L. At the top of the overflow box B is provided a vent pipe M connected to a siphon conical valve N in the form of a tap. Adjustment of the tap controls the amount of air that enters the overflow box B to reduce the vacuum that is caused in the hydrocyclone due to the discharge of the water in the overflow pipe K. The siphon reduces the vacuum within the hydrocyclone and therefore overcomes the possibility of solids being drawn up back into the hydrocyclone from spigot H. The hydrocyclone incorporating the fishtail illustrated in FIG. 1 is well-known and is used for the beneficiation and dewatering of aqueous slurries such as sand and water.

Whilst the siphon control valve N can be adjusted to operate within limited parameters there is a problem that the hydrocyclone only operates satisfactorily for a limited range of operation. Beyond this limit, such as when feed tonnages rise excessively, the cyclone may choke. To prevent choking from occurring more air has to be allowed into the overflow box B and this requires adjustment of the siphon control valve N.

Figure 2:
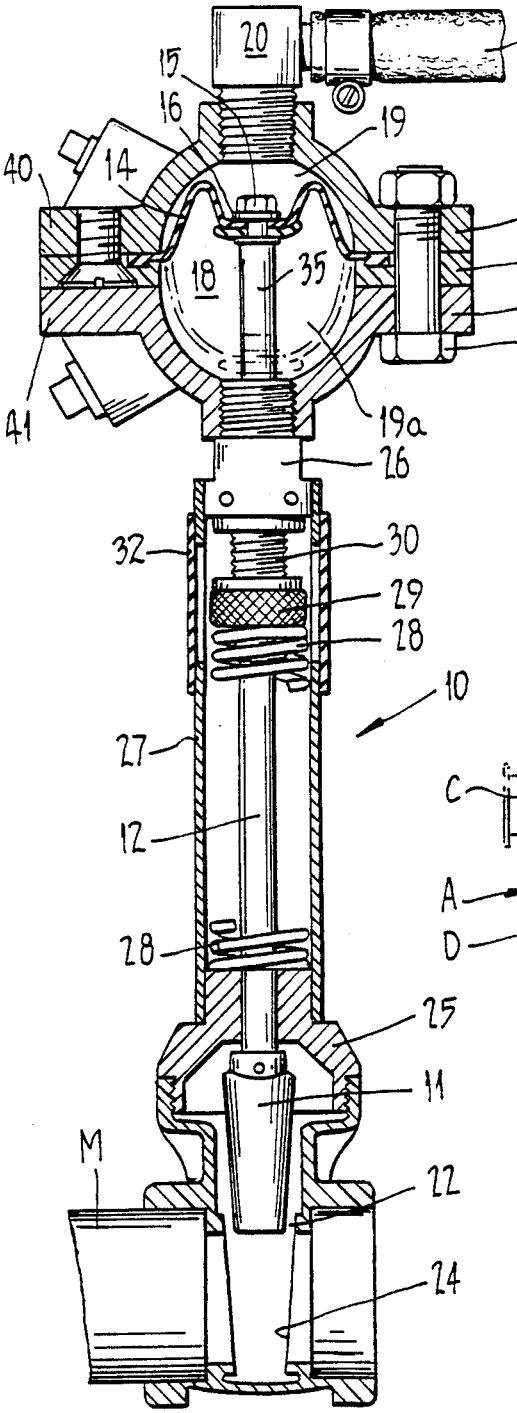
FIG. 2 is a cross sectional view of a pressure compensating siphon valve for use with the hydrocyclone illustrated in FIG. 1.
Figure 3:
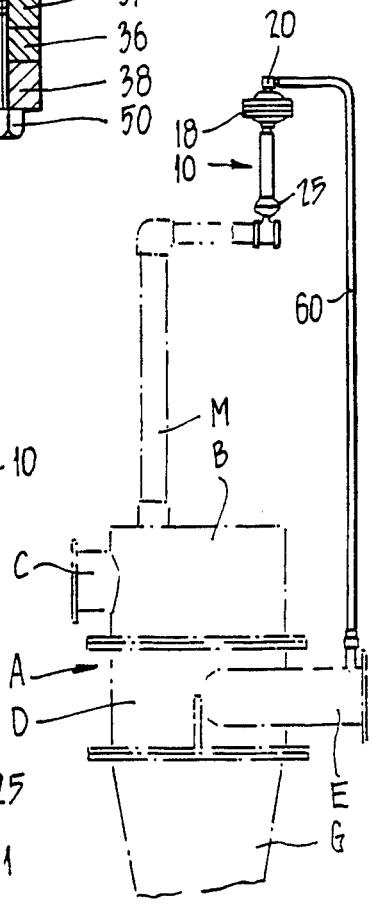
FIG. 3 is a side on illustration of the installation of the pressure compensating siphon valve.

The embodiment of the present invention concerns a pressure compensating siphon valve 10 illustrated in FIG. 2 that is installed to the hydrocyclone A as shown in FIG. 3. The pressure compensating siphon valve 10 comprises valve member 11 coupled to a valve rod 12 that in turn is attached to a diaphragm 14 positioned in a pressure chamber 18. one side 19 of the diaphragm 14 is in fluid communication with an inlet pipe 20 that, as shown in FIG. 3 is coupled to the feedpipe E of the hydrocyclone. The other side 19*a* of the diaphragm is open to the atmosphere. The valve member 11 is arranged to allow variable entry of air into the vent pipe M of the hydrocyclone, the air entering via an aperture 22 of variable cross section as shown in FIG. 2.

The valve member 11 is of tapered cross section and is arranged to seat in a correspondingly tapered seat 24. The valve rod 12 that is supported on bearings 25 and 26 in a coaxial sleeve 27. A coil spring 28 is arranged coaxially between the bearing 25 at one end of the valve rod and a knurled adjustor ring 29 that is in screwthreaded engagement on the end 30 of the rod. The sleeve 27 is provided with a removable portion 32 to allow access to the knurled ring 29 so that by moving the ring axially along the length of the end 30 of the rod 12 the spring rate can be varied. The valve rod 12 is also provided with an extension piece 35 that extends into the pressure chamber 18 to be coupled to the diaphragm 14 via a threaded spigot and nut and washer assembly 15, 16. The diaphragm 14 is arranged to extend across the centre of the spherical pressure chamber 18 and is located within a clamp plate 36 that is in turn clamped between radially extending flanges 37, 38 of the two halves 40 and 41 of the pressure chamber. The two halves 40, 41 of the pressure chamber are secured together by spaced apart nut and bolt assemblies 50.

In use the valve is adjusted so that the spring urges the valve member 11 to the fully open position shown in FIG. 2. However, when the infeed pressure increases above a certain level the diaphragm 14 is flexed to cause the valve member 11 to move against its seat 24 to partially block the air inlet passageway 22. In an extreme position the diaphragm 14 assumes the profile shown in phantom in FIG. 2 and the valve member extends to a fully seated position, totally blocking entry of air into the vent pipe M. When the assembly is set up a technician adjusts the spring load by adjustment of the knurled ring 29 to ensure that the valve provides the desired positive response. The response is varied depending on the use to which the hydrocyclone is to be put and reflects variation in feed tonnages and in particular the water content of feed tonnages and the pressure of the infeed.

As shown in FIG. 3 the pressure compensating siphon valve 10 can be simply installed to an existing hydrocyclone, the pressure within the feed pipe E being transferred to the valve 10, via a pipe 60 that communicates with the pressure chamber 18.

It has been discovered that use of this type of pressure communicating siphon valve in hydrocyclones incorporating fishtails of the kind illustrated in FIG. 1 increases the flexibility and parameters for operation of the hydrocyclone and overcomes the necessity for frequent maintenance and adjustment of the siphon valve. In this way users of this equipment can obtain consistent solids discharge over a large range of operating parameters.

Having now described my invention, what I claim is:

1. In a hydrocyclone comprising a frusto conical feed box extension, a feed box attached to the larger end of the feed box extension, the feed box having a tangential feed pipe, an overflow box positioned over the feed box and including an overflow pipe and a vent pipe, and a fish tail at the narrower end of the feed box extension, the improvement wherein a pressure compensating valve is positioned in the vent pipe, said valve having a fluid actuator in fluid communication with said feed pipe for direct actuation of the valve by the pressure within the feed pipe.

2. The improvement according to claim 1 wherein the pressure compensating valve comprises a valve seat, a valve member biased toward an open position and a pressure chamber spaced from the valve seat, said fluid actuator comprising a diaphragm located in the pressure chamber and drivably connected to the valve member, one side of the diaphragm being in direct fluid communication with the feed pipe whereby variation of the pressure within the feed pipe directly causes the diaphragm to displace the valve member to a partially or totally closed position against the associated valve seat.

3. The improvement according to claim 2 wherein the valve member is coupled to the diaphragm via a rod, and a coil spring co-axially surrounds the rod.

4. The improvement according to claim 3 wherein means is provided to adjust the rate of the coil spring.

5. The improvement according to claim 4 wherein the means to adjust the rate of the coil spring comprises a nut in threaded engagement on the valve rod and displaceable to compress the spring.

6. The improvement according to claim 2 wherein the valve member and valve seat have correspondingly tapered cross-sections.

* * * * *